US012790700B2

(12) United States Patent
Lee et al.

(10) Patent No.: US 12,790,700 B2
(45) Date of Patent: Nov. 10, 2026

(54) POROUS TRANSPORT LAYER FOR CATHODE AND WATER ELECTROLYSIS CELL COMPRISING THE SAME

(71) Applicants: Hyundai Motor Company, Seoul (KR); Kia Corporation, Seoul (KR)

(72) Inventors: Ji Han Lee, Seongnam-Si (KR); Hyo Kyung Han, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 799 days.

(21) Appl. No.: 18/127,935

(22) Filed: Mar. 29, 2023

(65) Prior Publication Data

US 2024/0191372 A1 Jun. 13, 2024

(30) Foreign Application Priority Data

Dec. 13, 2022 (KR) ..... 10-2022-0173894

(51) Int. Cl.
*C25B 11/032* (2021.01)
*C25B 1/04* (2021.01)
*C25B 9/19* (2021.01)

(52) U.S. Cl.
CPC ..... *C25B 11/032* (2021.01); *C25B 1/04* (2013.01); *C25B 9/19* (2021.01)

(58) Field of Classification Search
None
See application file for complete search history.

(56) References Cited

U.S. PATENT DOCUMENTS

2004/0016638 A1* 1/2004 LaConti ..... C25B 9/19 429/492
2005/0106450 A1* 5/2005 Castro ..... H01M 4/926 429/534
2010/0028744 A1* 2/2010 Wieser ..... H01M 8/0234 429/535

FOREIGN PATENT DOCUMENTS

CN 106784943 B 5/2019
JP 6142963 B2 6/2017
KR 102168378 B1 10/2020

* cited by examiner

*Primary Examiner* — Louis J Rufo
(74) *Attorney, Agent, or Firm* — Banner & Witcoff, Ltd.

(57) ABSTRACT

The present disclosure relates to a porous transport layer for a cathode comprising carbon fibers and polymer resin, an intermediate substrate layer disposed on the lower substrate layer and containing carbon fibers, and a microporous layer disposed on the intermediate substrate layer. The lower substrate layer may comprise a first lower substrate layer, and a second lower substrate layer disposed on the first lower substrate layer and having an average density lower than an average density of the first lower substrate layer. The intermediate substrate layer may be disposed on the second lower substrate layer. A water electrolysis cell may comprise the porous transport layer and the cathode.

20 Claims, 7 Drawing Sheets

SECOND LOWER SUBSTRATE LAYER

FIRST LOWER SUBSTRATE LAYER

POROUS TRANSPORT LAYER FOR CATHODE AND WATER ELECTROLYSIS CELL COMPRISING THE SAME

CROSS-REFERENCE TO RELATED APPLICATION

This application claims the benefit of priority to Korean Patent Application No. 10-2022-0173894, filed in the Korean Intellectual Property Office on Dec. 13, 2022, the entire contents of which are incorporated herein by reference.

TECHNICAL FIELD

The present disclosure relates to a porous transport layer for a cathode and a water electrolysis cell comprising the same.

BACKGROUND

A polymer electrolyte membrane (PEM) water electrolysis system may comprise an electro-chemical conversion device that decomposes water ($H_2O$) into hydrogen ($H_2$) and oxygen ($O_2$) using electricity. The PEM water electrolysis system may be operated at a high current density, may produce high-purity hydrogen and oxygen (e.g., because a gas permeability via a solid electrolyte membrane is low), and may have high stability. Such PEM water electrolysis system may comprise (e.g., is composed of) a PEM water electrolysis stack and a peripheral device for driving the same, and the PEM water electrolysis stack may comprise (e.g., is composed of) a plurality of PEM water electrolysis cells.

In addition, the PEM water electrolysis system may have a structure similar to that of a fuel cell, but may require a higher fastening force to secure airtightness at an operation pressure of 30 barg and prevent an increase in an internal contact resistance. A porous transport layer on a cathode side may apply a high-density carbon fiber structure thereto to prevent structural deformation and to withstand such fastening force and internal pressure. In addition, the porous transport layer on the cathode side may not have a separate separator flow path, so that the carbon fiber structure serves as a passage for discharging hydrogen and moisture generated from the cathode.

Descriptions in this background section are provided to enhance understanding of the background of the disclosure, and may include descriptions other than those of the prior art already known to those of ordinary skill in the art to which this technology belongs.

SUMMARY

The following summary presents a simplified summary of certain features. The summary is not an extensive overview and is not intended to identify key or critical elements.

An aspect of the present disclosure provides a porous transport layer for a cathode and a water electrolysis cell comprising the same that comprise at least two lower substrate layers with different average densities to make it easy to discharge water, thereby preventing corrosion of a separator.

The technical problems to be solved by the present disclosure are not limited to the aforementioned problems, and any other technical problems not mentioned herein will be clearly understood from the following description by those skilled in the art to which the present disclosure pertains.

A porous transport layer may comprise: a lower substrate layer comprising carbon fibers and polymer resin; an intermediate substrate layer disposed on the lower substrate layer and comprising carbon fibers; and a microporous layer disposed on the intermediate substrate layer, wherein the lower substrate layer comprises: a first lower substrate layer; and a second lower substrate layer disposed on the first lower substrate layer and having an average density lower than an average density of the first lower substrate layer, and wherein the intermediate substrate layer is disposed on the second lower substrate layer.

The carbon fibers comprised in the intermediate substrate layer may comprise at least one of: a carbon cloth, a carbon paper, a carbon felt, or a carbon sheet.

The first lower substrate layer may have the average density in a range from 0.46 to 0.65 g/cm$^3$, and the second lower substrate layer may have the average density in a range from 0.30 to 0.45 g/cm$^3$.

The lower substrate layer may further comprise a third lower substrate layer having an average density that is lower than the average density of the first lower substrate layer and higher than the average density of the second lower substrate layer, and the third lower substrate layer may be disposed between the first lower substrate layer and the second lower substrate layer.

The lower substrate layer may further comprise a third lower substrate layer having an average density in a range from 0.46 to 0.65 g/cm$^3$, and the third lower substrate layer may be disposed beneath the first lower substrate layer.

The first lower substrate layer and the third lower substrate layer may have the same average density.

The lower substrate layer may further comprise a third lower substrate layer having an average density in a range from 0.30 to 0.45 g/cm$^3$, and the third lower substrate layer may be disposed on top of the second lower substrate layer.

The second lower substrate layer and the third lower substrate layer may have the same average density.

The lower substrate layer may have an average thickness in a range from 200 to 1,500 μm.

The polymer resin may comprise a phenolic polymer.

The lower substrate layer may further comprise a water repellent.

The water repellent may comprise at least one of: polytetrafluoroethylene (PTFE), tetrafluoroethylene-perfluoroalkyl vinyl ether copolymer (PFA), tetrafluoroethylene-hexafluoropropylene copolymer (FEP), polychlorotrifluoroethylene (PCTFE), tetrafluoroethylene-ethylene copolymer (ETFE), or polyfluorovinylidene (PVDF).

The water repellent may be comprised in the lower substrate layer, and a content of the water repellent may be in a range from 0.5 to 10% by weight based on a total weight of the lower substrate layer.

Each of the first lower substrate layer and the second lower substrate layer may comprise a water repellent, and a content of the water repellent comprised in the first lower substrate layer may be greater than a content of the water repellent comprised in the second lower substrate layer.

The content of the water repellent comprised in the first lower substrate layer may be in a range from 51 to 95% by weight of a total amount of the water repellent comprised in the lower substrate layer, and the content of the water repellent comprised in the second lower substrate layer may be in a range from 5 to 49% by weight of the total amount of the water repellent comprised in the lower substrate layer.

A thickness ratio of the first lower substrate layer and the second lower substrate layer may be in a range from 1:0.5 to 1:1.5.

A water electrolysis cell may comprise: a first layer; and a porous transport layer for the first layer, wherein the porous transport layer comprises: a lower substrate layer comprising carbon fibers and polymer resin; an intermediate substrate layer disposed on the lower substrate layer and comprising carbon fibers; and a microporous layer disposed on the intermediate substrate layer, wherein the lower substrate layer comprises: a first lower substrate layer; and a second lower substrate layer disposed on the first lower substrate layer and having an average density lower than an average density of the first lower substrate layer, and wherein the intermediate substrate layer is disposed on the second lower substrate layer.

The water electrolysis cell may further comprise a cathode disposed on the microporous layer of the porous transport layer, wherein the first layer comprises the cathode; and a separator for the cathode, wherein the lower substrate layer of the porous transport layer is disposed on the separator for the cathode.

A porous transport layer may comprise at least two lower substrate layers with different average densities to make it easy to discharge water, thereby preventing corrosion of a separator.

According to an aspect of the present disclosure, provided is a porous transport layer for a cathode comprising a lower substrate layer containing carbon fibers and polymer resin, an intermediate substrate layer disposed on the lower substrate layer and containing carbon fibers, and a microporous layer disposed on the intermediate substrate layer.

The lower substrate layer may comprise a first lower substrate layer, and a second lower substrate layer disposed on the first lower substrate layer and having an average density lower than an average density of the first lower substrate layer.

The intermediate substrate layer may be disposed on the second lower substrate layer.

According to another aspect of the present disclosure, provided is a water electrolysis cell comprising the porous transport layer for the cathode.

These and other features and advantages are described in greater detail below.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Herein, when a certain portion "comprises" a certain component, this means that the certain portion may further comprise other components without excluding said other components unless otherwise stated.

Herein, when a first member is located on a "surface", "one surface", "the other surface" or "both surfaces" of a second member, this comprises not only a case in which the first member is in contact with the second member, but also a case in which a third member exists between the two members.

Figure 1:
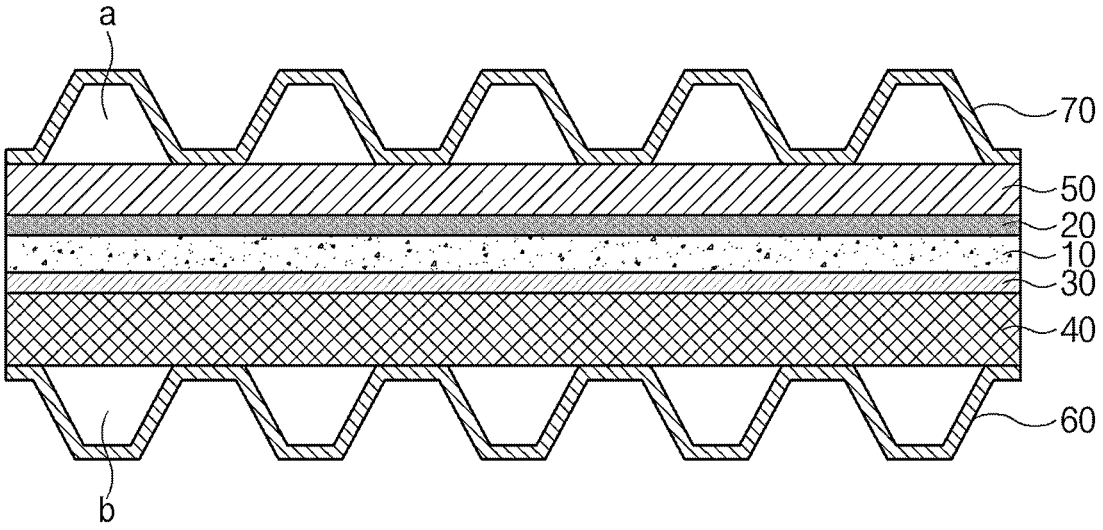
FIG. 1 is a cross-sectional view of a polymer electrolyte membrane (PEM) water electrolysis cell according to a related art.

Referring to FIG. 1, a PEM water electrolysis cell may comprise a membrane-electrode assembly (MEA) comprising an electrolyte membrane 10, an anode 20, a cathode 30, a porous transport layer (PTL) 40 for the cathode, a porous transport layer (PTL) 50 for the anode, a separator 60 for the cathode, and a separator 70 for the anode. In this regard, water introduced via a separator flow path 'a' for the anode may be supplied to the anode 20 via the PTL 50 for the anode, and hydrogen gas generated at the cathode 30 may be discharged via the PTL 40 for the cathode and a separator flow path 'b' for the cathode. In an electrochemical reaction of such PEM water electrolysis cell, after the water supplied to the anode is separated into hydrogen ions ($H^+$) and electrons together with oxygen gas ($O_2$) by an oxygen evolution reaction (OER), the hydrogen ions ($H^+$) and the electrons may move to the cathode via the electrolyte membrane and an external circuit, respectively, and may generate the hydrogen gas by a hydrogen evolution reaction.

The PTL for the cathode may play a role of discharging the hydrogen generated at the cathode and the moisture existing by being diffused from the anode to the cathode via the separator. Such PTL for the cathode may require various physical properties such as corrosion resistance, distributivity and diffusivity, low surface roughness, and mechanical strength.

The water as a reactant may diffuse from the anode to the cathode, and the water diffused toward the cathode may remain in pores of the porous transport layer for the cathode and block a discharge passage of the hydrogen as a product, which may cause a problem of reducing an efficiency of the system. In addition, the water remaining in the pores of the porous transport layer may diffuse to the separator for the cathode, which may cause corrosion of the separator. Therefore, it is necessary to research and develop a porous transport layer for the cathode and a method for preparing the same that have excellent system efficiency as the corrosion of the separator for the cathode caused by the moisture is prevented and the discharge of the hydrogen, which is the product, is not interfered by easily discharging the water.

In one or more examples, the porous transport layer for the cathode may comprise a lower substrate layer containing carbon fibers and polymer resin, an intermediate substrate layer disposed on the lower substrate layer and containing the carbon fibers, and a microporous layer disposed on the intermediate substrate layer. The lower substrate layer may comprise a first lower substrate layer, and a second lower substrate layer disposed on the first lower substrate layer. The second lower substrate layer may have a lower average density than the first lower substrate layer.

Figure 2:
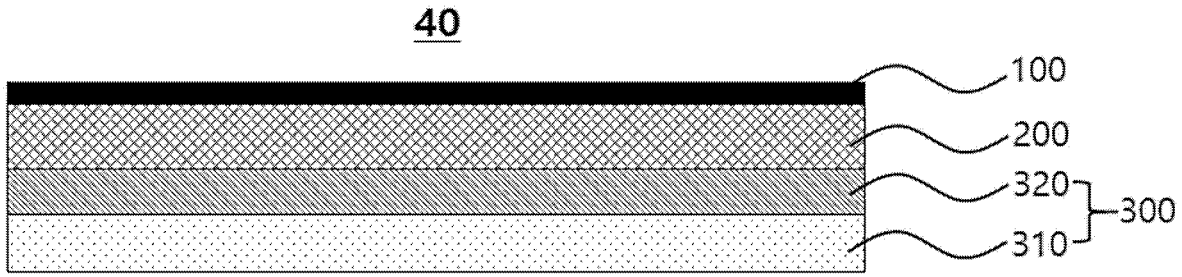
FIG. 2 is cross-sectional views of a porous transport layer for a cathode.

Referring to FIG. 2, the porous transport layer 40 for the cathode may have a structure in which a microporous layer 100, an intermediate substrate layer 200, and a lower substrate layer 300 are stacked in order, and the lower substrate layer 300 may comprise a first lower substrate layer 310, and a second lower substrate layer 320 having a lower average density than the first lower substrate layer 310.

The lower substrate layer (e.g., the lower substrate layer 300 or any other lower substrate layer described herein) may comprise the first lower substrate layer, and the second lower substrate layer having the lower average density than the first lower substrate layer. As described above, for example, by having the two lower substrate layers with the different average densities, the porous transport layer for the cathode may reduce a contact resistance between the lower substrate layer and the separator, and effectively discharge the moisture via the second lower substrate layer (e.g., the second lower substrate layer 320 or any other second lower substrate layer described herein) to reduce or prevent the corrosion of the separator for the cathode caused by the diffusion of the moisture to the separator for the cathode.

The lower substrate layer may comprise (e.g., contain) the carbon fibers and the polymer resin. For example, the lower substrate layer may be prepared by impregnating a web of the carbon fibers into the polymer resin and drying the web (e.g., after the impregnating the web of the carbon fibers). For example, the lower substrate layer may comprise (e.g., contain) a composite of the carbon fibers and the polymer resin. In an example, each of the first lower substrate layer and the second lower substrate layer may independently contain the composite of the carbon fibers and the polymer resin.

The web of the carbon fibers may comprise at least one of: a carbon cloth, a carbon paper, a carbon felt, and/or a carbon sheet. In this regard, the web of the carbon fibers may be single-layered or multi-layered, for example, depending on a target thickness of the lower substrate layer.

A polymer generally applicable as a material for the porous transport layer for the cathode may be applied to the polymer resin, but aspects are not limited as such. For example, the polymer may be a phenol-based polymer, but may not be limited thereto.

The lower substrate layer may comprise the first lower substrate layer and the second lower substrate layer in a direction from the outside to the intermediate substrate layer (see, e.g., FIG. 2). For example, the porous transport layer for the cathode may comprise the second lower substrate layer having the relatively low average density at a side near the intermediate substrate layer and may comprise the first lower substrate layer with the relatively high average density at a side near the outside. Flow passages of the hydrogen and the moisture may be separated from each other (e.g., because of the above-described structural features), so that mass transfer may become smooth, and a contact of the moisture with the separator for the cathode may be suppressed to reduce or prevent the corrosion of the separator.

For example, the lower substrate layer may comprise the first lower substrate layer having a first average density (e.g., in a range from 0.46 to 0.65 g/cm$^3$) and the second lower substrate layer having a second average density (e.g., in a range from 0.30 to 0.45 g/cm$^3$). In an example, the lower substrate layer may comprise the first lower substrate layer having an average density in a range from 0.48 to 0.63 g/cm$^3$ and the second lower substrate layer having an average density in a range from 0.35 to 0.43 g/cm$^3$.

If the average density of the first lower substrate layer is lower than the above range, a moisture blocking effect of the first lower substrate layer may be reduced. If the average density of the first lower substrate layer exceeds the above range, an increase in a mass transfer resistance may occur, for example, based on reduction of pores in the first lower substrate layer. If the average density of the second lower substrate layer is lower than the above range, stiffness of the second lower substrate layer may be reduced. If the average density of the second lower substrate layer exceeds the above range, a property of discharging the moisture based on the second lower substrate layer may be deteriorated.

Figure 3:
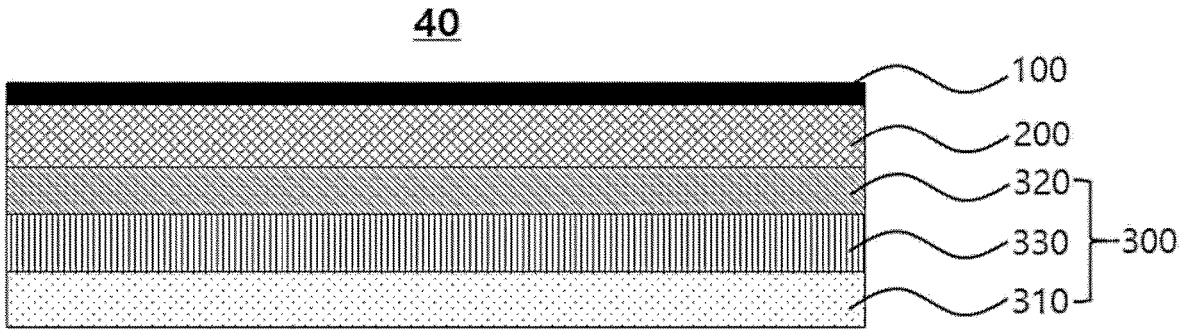
FIG. 3 is cross-sectional views of a porous transport layer for a cathode.

As an example, the lower substrate layer may (e.g., additionally) comprise a third lower substrate layer having an average density lower than the average density of the first lower substrate layer and higher than the average density of the second lower substrate layer at a location between the first lower substrate layer and the second lower substrate layer. Referring to FIG. 3, the lower substrate layer 300 may comprise the first lower substrate layer 310, a third lower substrate layer 330, and the second lower substrate layer 320 in order in the direction from the outside toward the intermediate substrate layer 200. In this regard, the average densities of the respective lower substrate layers may gradually decrease in the direction from the outside of the lower substrate layer to the intermediate substrate layer 200. For example, the average densities may decrease in an order of the first lower substrate layer, the third lower substrate layer, and the second lower substrate layer.

The lower substrate layer may (e.g., additionally) comprise a fourth lower substrate layer having an average density in a range from 0.46 to 0.65 g/cm$^3$, from 0.48 to 0.63 g/cm$^3$, or from 0.53 to 0.60 g/cm$^3$ beneath the first lower substrate layer. In this regard, the fourth lower substrate layer may be different from or the same as the first lower substrate layer in the material and/or the average density. In an example, the first lower substrate layer and the fourth lower substrate layer may be the same as each other in the material and the average density.

Figure 4:
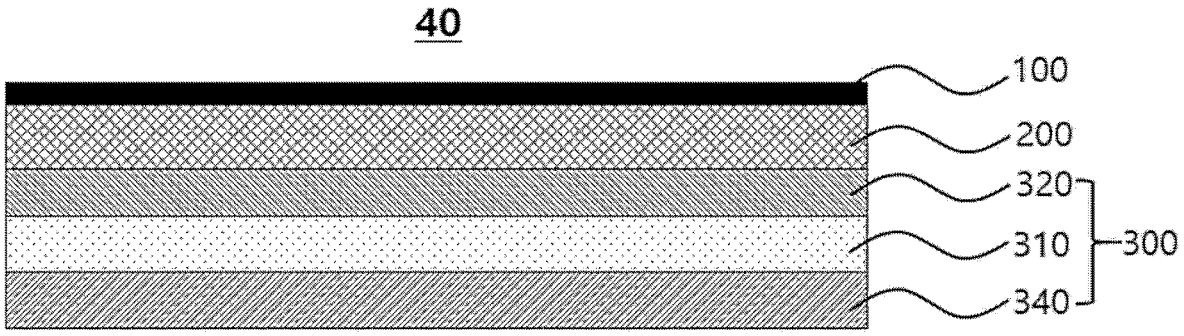
FIG. 4 is cross-sectional views of a porous transport layer for a cathode.

Referring to FIG. 4, the lower substrate layer 300 may comprise a fourth lower substrate layer 340, the first lower substrate layer 310, and the second lower substrate layer 320 in order in the direction from the outside toward the intermediate substrate layer 200. In this regard, the average densities of the respective lower substrate layers may gradually decrease in the direction from the outside of the lower substrate layer to the intermediate substrate layer 200. For example, the average densities may decrease in an order of the fourth lower substrate layer 340, the first lower substrate layer 310, and the second lower substrate layer 320, or the fourth lower substrate layer 340 and the first lower substrate layer 310 may have the same (or substantially the same) average density and the average density of the second lower substrate layer may be lower than that of the first and fourth lower substrate layers.

The lower substrate layer may (e.g., additionally) comprise a fifth lower substrate layer having an average density in a range from 0.30 to 0.45 g/cm$^3$ or from 0.35 to 0.43 g/cm$^3$ on top of the second lower substrate layer. For example, the lower substrate layer may comprise a form in which the first lower substrate layer, the second lower substrate layer, and the fifth lower substrate layer are sequentially stacked, and the intermediate substrate layer may be disposed on the fifth lower substrate layer.

In this regard, the fifth lower substrate layer may be different from or the same as the second lower substrate layer in the material and/or the average density. In an example, the second lower substrate layer and the fifth lower substrate layer may be the same as each other in the material and the average density.

Figure 5:
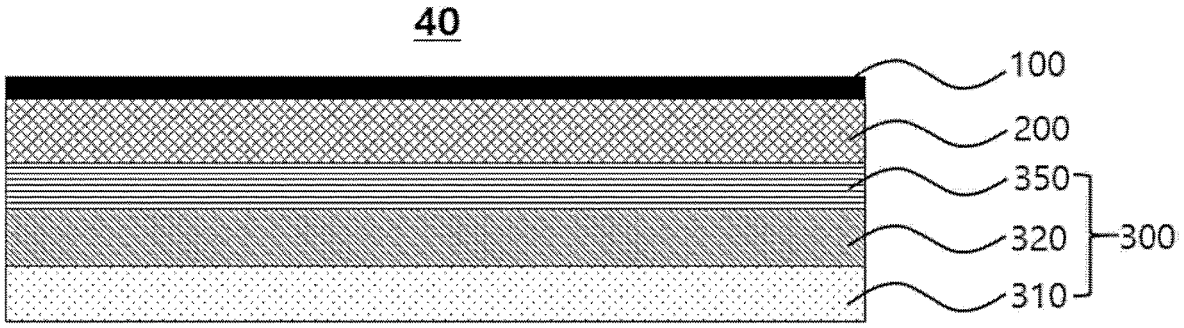
FIG. 5 is cross-sectional views of a porous transport layer for a cathode.

Referring to FIG. 5, the lower substrate layer 300 may comprise the first lower substrate layer 310, the second lower substrate layer 320, and a fifth lower substrate layer 350 in order in the direction from the outside to the intermediate substrate layer 200. In this regard, the average densities of the respective lower substrate layers may gradually decrease in the direction from the outside of the lower substrate layer to the intermediate substrate layer 200. For example, the average densities may decrease in an order of the first lower substrate layer 310, the second lower substrate layer 320, and the fifth lower substrate layer 350, or the second lower substrate layer and the fifth lower substrate layer may have the same (or substantially the same) average density and the average density of the first lower substrate layer may be higher than those of the second and fifth lower substrate layers.

The lower substrate layer may have an average thickness in a range from 200 to 1,500 μm. In an example, the lower substrate layer may have the average thickness in a range from 300 to 1,500 μm or from 500 to 900 μm. If the average thickness of the lower substrate layer is lower than the above range, stiffness of the prepared porous transport layer for the cathode may decrease or the mass transfer resistance may increase, and if the average thickness of the lower substrate layer exceeds the above range, it may be difficult to build a miniaturized system because of an excessive system volume.

In an example, the first lower substrate layer and the second lower substrate layer may have a thickness ratio in a range from 1:0.5 to 1:1.5 or from 1:0.8 to 1:1.2. If the thickness ratio of the first lower substrate layer with the relatively high density and the second lower substrate layer with the relatively low density is within the above range, the contact resistance against the separator may be reduced, and the moisture may be easily discharged via the second lower substrate layer, which may be effective in reducing or preventing the corrosion of the separator for the cathode caused by the diffusion of the moisture to the separator for the cathode.

The lower substrate layer may additionally contain a water repellent. In this regard, the water repellent may play a role of reducing or preventing the separator from being corroded by the moisture by preventing the diffusion of the moisture to the separator for the cathode.

The water repellent may be used without particular limitation as long as the fiber may be used in the preparation of the PTL, and, for example, may comprise at least one of polytetrafluoroethylene (PTFE), tetrafluoroethylene-perfluoroalkyl vinyl ether copolymer (PFA), tetrafluoroethylene-hexafluoropropylene copolymer (FEP), polychlorotrifluoroethylene (PCTFE), tetrafluoroethylene-ethylene copolymer (ETFE), or polyfluorovinylidene (PVDF). In an example, the water repellent may be the polytetrafluoroethylene (PTFE).

The water repellent may be contained in the lower substrate layer, for example, in a content in a range from 0.5 to 10% by weight, from 1 to 5% by weight, or from 2 to 4% by weight based on a total weight of the lower substrate layer.

The water repellent may be contained in the same concentration in the first lower substrate layer and the second lower substrate layer (and/or in other substrate layers), or a concentration of the water repellent in the first lower substrate layer may be higher than a concentration of the water repellent in the second lower substrate layer. For example, a content of the water repellent in the first lower substrate layer may be equal to or higher than a content of the water repellent in the second lower substrate layer.

In an example, each of the first lower substrate layer and the second lower substrate layer may comprise (e.g., further contain) the water repellent, and the content of the water repellent in the first lower substrate layer may be higher than the content of the water repellent in the second lower substrate layer. As such, if the content of the water repellent in the first lower substrate layer is higher than the content of the water repellent in the second lower substrate layer, the corrosion of the separator may be reduced or prevented as the moisture diffused from the anode to the cathode is suppressed from coming into contact with a surface of the separator for the cathode.

In an example, the water repellent may be contained in the lower substrate layer, for example, in the content in the range from 0.5 to 10% by weight, from 1 to 5% by weight, or from 2 to 4% by weight based on the total weight of the lower substrate layer. In this regard, the first lower substrate layer may comprise (e.g., contain) the water repellent, for example, in a content in a range from 51 to 95% by weight, 70 to 95% by weight, or 75 to 85% by weight of a total amount of the water repellent, and the second lower substrate layer may contain the water repellent, for example, in a content in a range from 5 to 49%, 5 to 30%, or 15 to 25% by weight of the total amount of the water repellent.

The intermediate substrate layer (e.g., the intermediate substrate layer 200 described herein) may serve to support the microporous layer.

The intermediate substrate layer may comprise (e.g., contain) the carbon fibers, and the carbon fibers may be used without particular limitation as long as the carbon fibers may be used in the preparation of the PTL. For example, the carbon fibers may comprise at least one of: the carbon cloth, the carbon paper, carbon felt, and/or the carbon sheet. In an example, the intermediate substrate layer may be made of the carbon fibers.

The intermediate substrate layer may have an average thickness, for example, in a range from 100 to 300 μm, or from 130 to 250 μm.

A microporous layer (e.g., the microporous layer 100 described herein) may protect the membrane-electrode assembly from being physically damaged by the carbon fibers constituting the porous transport layer for the cathode, and may prevent deterioration of the hydrogen evolution reaction caused by accumulation of the moisture in a cathode electrode layer.

The microporous layer may be used without particular limitation as long as it may be used in the preparation of the PTL, and may comprise (e.g., contain), for example, carbon powder and the water repellent.

The carbon powder may be used without particular limitation as long as it may be generally used in the preparation of the PTL, and may comprise at least one of: activated carbon, carbon black, acetylene black, Ketjen black, Denka black, carbon whisker, activated carbon fiber, vapor grown carbon fiber (VGCF), carbon aerosol, carbon nanotube, carbon nanofiber, carbon nanohorn, and/or natural or synthetic graphite.

The water repellent may be used without particular limitation as long as it may be used in the preparation of PTL, and, for example, may comprise at least one of: the polytetrafluoroethylene (PTFE), the tetrafluoroethylene-perfluoroalkyl vinyl ether copolymer (PFA), the tetrafluoroethylene-hexafluoropropylene copolymer (FEP), the polychlorotrifluoroethylene (PCTFE), the tetrafluoroethylene-ethylene copolymer (ETFE), and/or the polyfluorovinylidene (PVDF) In an example, the water repellent may be the polytetrafluoroethylene (PTFE).

The microporous layer may comprise (e.g., contain) 100 parts by weight of the carbon powder and 15 to 30 parts by weight of the water repellent. In an example, the microporous layer may contain 100 parts by weight of the carbon powder and 20 to 25 parts by weight of the water repellent. If the content of the water repellent with respect to the carbon powder in the microporous layer is within the above range, a binding force and water repellency of the carbon powder may be secured without increasing a resistance of the porous transport layer.

The microporous layer may comprise (e.g., additionally contain) a dispersant and a binder, and the dispersant and the binder may be used without particular limitation as long as they may be generally used in the preparation of the PTL.

The microporous layer may have an average thickness, for example, in a range from 30 to 100 μm or from 50 to 80 μm. If the average thickness of the microporous layer is lower than the above range, the membrane-electrode assembly (MEA) may be damaged caused by exposure of the carbon fibers, and if the average thickness of the microporous layer exceeds the above range, a performance of the water electrolysis cell may deteriorate as suppression of hydrogen and/or moisture discharge caused by a high-density structure occurs.

The porous transport layer for the cathode as described above may have a low surface roughness on a surface thereof in contact with the separator to reduce the contact resistance against the separator, thereby improving a performance of the PEM water electrolysis system. In the porous transport layer for the cathode, it may be easy to discharge the moisture, so that the moisture existing by being diffused from the anode to the cathode is suppressed from reaching the separator on the cathode side, and the corrosion of the separator on the cathode side may be reduced or prevented. Therefore, durability of the PEM water electrolysis system may be improved.

The water electrolysis cell may comprise the porous transport layer for the cathode as described above.

For example, the water electrolysis cell may (e.g., additionally) comprise the cathode disposed on the microporous layer of the porous transport layer for the cathode, and the separator for the cathode disposed on the lower substrate layer of the porous transport layer for the cathode.

Figure 6:
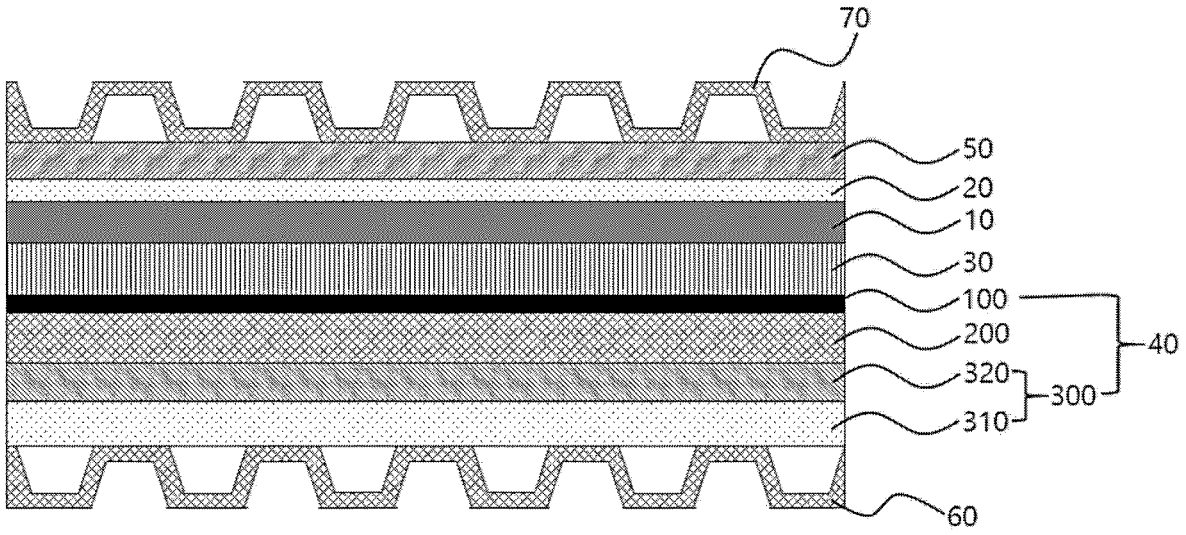
FIG. 6 is a cross-sectional view of a water electrolysis cell.

Referring to FIG. 6, the water electrolysis cell may comprise the separator 70 for the anode, the porous transport layer (PTL) 50 for the anode, the anode 20, the electrolyte membrane 10, the cathode 30, the porous transport layer (PTL) 40 for the cathode, and the separator 60 for the cathode in order. In this regard, the porous transport layer 40 for the cathode may comprise the microporous layer 100, the intermediate substrate layer 200, the second lower substrate layer 320, and the first lower substrate layer 310 in a direction from the cathode 30 to the separator 60 for the cathode. However, aspects are not limited as such, and other example layers may be used. For example, other examples of the porous transport layer 40 or the lower substrate layer 300 may be used.

The water electrolysis cell, comprising the porous transport layer for the cathode as described above, may have excellent hydrogen evolution reaction performance and durability.

A method for preparing the porous transport layer for the cathode may comprise: (e.g., sequentially) stacking (1) the lower substrate layer comprising the first lower substrate layer and the second lower substrate layer having the lower average density than the first lower substrate layer and containing the composite of the carbon fibers and the polymer resin, (2) the intermediate substrate layer formed on a surface (e.g., a side surface and/or a top surface) of the second lower substrate layer of the lower substrate layer and containing the carbon fibers, and (3) the microporous layer.

The lower substrate layer may be prepared by impregnating the web of the carbon fibers into the polymer resin and drying the web. In this regard, types, physical properties, and the like of the web of the carbon fibers and the polymer resin may be the same (or substantially the same) as those described for the porous transport layer for the cathode.

In an example, the lower substrate layer may be prepared by a method comprising: preparing a first sheet and a second sheet by impregnating the web of the carbon fibers into the polymer resin and drying the web, and adjusting a content of the polymer resin in the first sheet to be higher than a content of the polymer resin in the second sheet, and stacking, carbonizing, and graphitizing the first sheet and the second sheet.

For example, the first sheet may be carbonized and graphitized to become the high-density first lower substrate layer with the relatively high average density, and the second sheet may be carbonized and graphitized to become the low-density second lower substrate layer with the relatively low average density.

The carbonization may be performed, for example, at a temperature equal to or higher than 1,400° C. or in a range from 1,400 to 1,700° C. The graphitization may be performed, for example, at a temperature equal to or higher than 2,000° C. or in a range from 2,000 to 2,500° C.

The lower substrate layer may be prepared by the method (e.g., additionally) comprising performing a surface treatment on a carbonized and graphitized stacked body with the water repellent. In an example, the surface treatment may be performed by a method of applying the water repellent to an outer side surface of the first lower substrate layer of the lower substrate layer as the carbonized and graphitized stacked body. Therefore, a content of the water repellent in the first lower substrate layer may be higher than a content of the water repellent in the second lower substrate layer.

Hereinafter, the present disclosure will be described in more detail with various examples. However, such Examples are only for helping understanding of the present disclosure, and the scope of the present disclosure is not limited to such Examples in any sense.

Preparation Example 1. Preparation of Lower Substrate Layer-1

A web of the carbon fibers having an average thickness of 200 μm (an average pore size: 50 μm) was impregnated into a formaldehyde resin, which is a phenolic polymer, dried at 180° C., and then cut into a sheet form to prepare a first carbon sheet.

A web of the carbon fibers (an average pore size: 50 μm) having an average thickness of 200 μm was impregnated into the formaldehyde resin, and an amount of impregnation of the formaldehyde resin was about 65% by weight relative to the first carbon sheet. Thereafter, this was dried and cut into a sheet form to prepare a second carbon sheet.

After stacking the second carbon sheet on the first carbon sheet, the stacked body was carbonized under a nitrogen atmosphere at 1,500° C. and graphitized at 2,000° C. to prepare a lower substrate layer-1. In this regard, the carbonized and graphitized first carbon sheet is the first lower substrate layer, and the carbonized and graphitized second carbon sheet is the second lower substrate layer.

Figure 7:
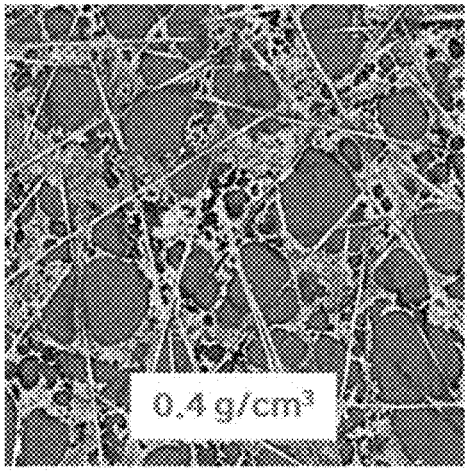
FIG. 7 shows CT images taken for a first lower substrate layer and a second lower substrate layer in a porous transport layer for a cathode.
Figure 7:
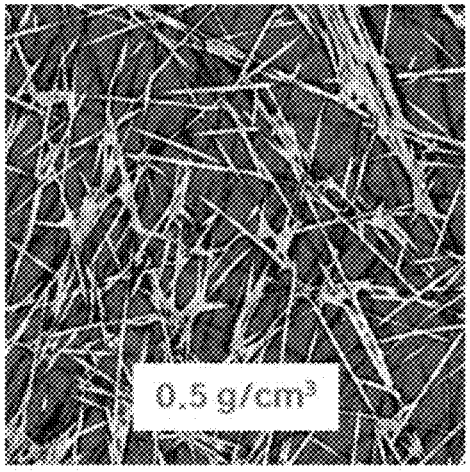

The densities of the prepared first lower substrate layer and the second lower substrate layer were measured by separately preparing sheets based on polymer contents of the respective layers, and average diameters of pores thereof were measured by mercury porosimetry. In addition, CT images of the prepared first lower substrate layer and second lower substrate layer were taken, and results thereof are shown in FIG. 7.

The measured density of the first lower substrate layer was about 0.5 g/cm$^3$ and the average pore diameter thereof was 30 μm, and the density of the second lower substrate layer was about 0.4 g/cm$^3$ and the average pore diameter thereof was 40 μm.

Example 1: Configuration of Porous Transport Layer for Cathode

A carbon sheet (a manufacturer: SGL, a product name: 36BB) having an average thickness of 280 μm was stacked on the second lower substrate layer of the lower substrate layer in Preparation Example 1 to prepare the porous transport layer-1 for the cathode. In this regard, the carbon sheet is in a form of the carbon paper with the high-density intermediate substrate layer and the microporous layer (MPL) on one surface of the intermediate substrate layer.

Example 2

A porous transport layer-2 for the cathode was prepared in the same manner as in Example 1 except that the polytetrafluoroethylene (PTFE) was applied as the water repellent with a content of 5% by weight with respect to the total weight of the lower substrate layer to the outer side of the first lower substrate layer of the porous transport layer for the cathode in Example 1.

Various examples of the porous transport layer for the cathode described herein have the low surface roughness on the surface thereof in contact with the separator to reduce the contact resistance against the separator, thereby improving the performance of the PEM water electrolysis system. In the porous transport layer for the cathode, it is easy to discharge the moisture, so that the moisture existing by being diffused from the anode to the cathode is suppressed from reaching the separator on the cathode side, and the corrosion of the separator on the cathode side may be reduced or prevented. Therefore, the durability of the PEM water electrolysis system may be improved.

Various examples of the water electrolysis cell described herein, comprising the porous transport layer for the cathode, provide excellent oxygen evolution reaction performance and durability.

Hereinabove, although the present disclosure has been described with reference to various examples and the accompanying drawings, aspects of the present disclosure are not limited thereto, but may be variously modified and altered by those skilled in the art to which the present disclosure pertains without departing from the spirit and scope of the present disclosure claimed in the following claims.

What is claimed is:

1. A water electrolysis cell comprising:

a cathode, a porous transport layer for the cathode, and a separator, wherein the porous transport layer comprises:

a lower substrate layer comprising carbon fibers and polymer resin;

an intermediate substrate layer disposed on the lower substrate layer and comprising carbon fibers; and a microporous layer disposed on the intermediate substrate layer, wherein the lower substrate layer comprises:

a first lower substrate layer; and a second lower substrate layer disposed on the first lower substrate layer and having an average density lower than an average density of the first lower substrate layer, wherein the intermediate substrate layer is disposed on the second lower substrate layer, wherein the cathode is disposed on the microporous layer of the porous transport layer, and wherein the separator is disposed on the first lower substrate layer.

2. The water electrolysis cell of claim 1, wherein the carbon fibers comprised in the intermediate substrate layer comprise at least one of: a carbon cloth, a carbon paper, a carbon felt, or a carbon sheet.

3. The water electrolysis cell of claim 1, wherein the first lower substrate layer has the average density in a range from 0.46 to 0.65 g/cm3, and wherein the second lower substrate layer has the average density in a range from 0.30 to 0.45 g/cm3.

4. The water electrolysis cell of claim 1, wherein the lower substrate layer further comprises a third lower substrate layer having an average density that is lower than the average density of the first lower substrate layer and higher than the average density of the second lower substrate layer, and wherein the third lower substrate layer is disposed between the first lower substrate layer and the second lower substrate layer.

5. The water electrolysis cell of claim 1, wherein the lower substrate layer further comprises a third lower substrate layer having an average density in a range from 0.46 to 0.65 g/cm3, and wherein the third lower substrate layer is disposed beneath the first lower substrate layer.

6. The water electrolysis cell of claim 5, wherein the first lower substrate layer and the third lower substrate layer have the same average density.

7. The water electrolysis cell of claim 1, wherein the lower substrate layer further comprises a third lower substrate layer having an average density in a range from 0.30 to 0.45 g/cm3, and wherein the third lower substrate layer is disposed on top of the second lower substrate layer.

8. The water electrolysis cell of claim 7, wherein the second lower substrate layer and the third lower substrate layer have the same average density.

9. The water electrolysis cell of claim 1, wherein the lower substrate layer has an average thickness in a range from 200 to 1,500 μm.

10. The water electrolysis cell of claim 1, wherein the polymer resin comprises a phenolic polymer.

11. The water electrolysis cell of claim 1, wherein the lower substrate layer further comprises a water repellent.

12. The water electrolysis cell of claim 11, wherein the water repellent comprises at least one of: polytetrafluoroethylene (PTFE), tetrafluoroethylene-perfluoroalkyl vinyl ether copolymer (PFA), tetrafluoroethylene-hexafluoropropylene copolymer (FEP), polychlorotrifluoroethylene (PCTFE), tetrafluoroethylene-ethylene copolymer (ETFE), or polyfluorovinylidene (PVDF).

13. The water electrolysis cell of claim 11, wherein the water repellent is comprised in the lower substrate layer, and wherein a content of the water repellent is in a range from 0.5 to 10% by weight based on a total weight of the lower substrate layer.

14. The water electrolysis cell of claim 1, wherein each of the first lower substrate layer and the second lower substrate layer comprises a water repellent, and wherein a content of the water repellent comprised in the first lower substrate layer is greater than a content of the water repellent comprised in the second lower substrate layer.

15. The water electrolysis cell of claim 14, wherein the content of the water repellent comprised in the first lower substrate layer is in a range from 51 to 95% by weight of a total amount of the water repellent comprised in the lower substrate layer, and wherein the content of the water repellent comprised in the second lower substrate layer is in a range from 5 to 49% by weight of the total amount of the water repellent comprised in the lower substrate layer.

16. The water electrolysis cell of claim 1, wherein a thickness ratio of the first lower substrate layer and the second lower substrate layer is in a range from 1:0.5 to 1:1.5.

17. A water electrolysis cell comprising:

a first layer;

a porous transport layer for the first layer, wherein the porous transport layer comprises:

a lower substrate layer comprising carbon fibers and polymer resin;

an intermediate substrate layer disposed on the lower substrate layer and comprising carbon fibers; and a microporous layer disposed on the intermediate substrate layer;

a cathode disposed on the microporous layer of the porous transport layer; and a separator for the cathode, wherein the lower substrate layer of the porous transport layer is disposed on the separator for the cathode, wherein the lower substrate layer comprises:

a first lower substrate layer; and a second lower substrate layer disposed on the first lower substrate layer and having an average density lower than an average density of the first lower substrate layer, wherein the first layer comprises the cathode, and wherein the intermediate substrate layer is disposed on the second lower substrate layer.

18. An electrolysis cell comprising:

an anode;

an electrolyte membrane;

a separator;

a porous transport layer disposed on the separator; and a cathode disposed on the porous transport layer, wherein the porous transport layer comprises:

a lower substrate layer comprising polymer resin;

an intermediate substrate layer disposed on the lower substrate layer and comprising carbon fibers; and a microporous layer disposed on the intermediate substrate layer, wherein the lower substrate layer comprises:

a first lower substrate layer disposed on the separator; and a second lower substrate layer disposed on the first lower substrate layer and having an average density lower than an average density of the first lower substrate layer.

19. The electrolysis cell of claim 18, further comprising:

a second separator for the anode, wherein the electrolyte membrane is disposed on the cathode, wherein the anode is disposed on the electrolyte membrane.

20. The electrolysis cell of claim 19, further comprising:

a second porous transport layer disposed on the anode, wherein the second separator is disposed on the second porous transport layer, wherein the second separator comprises a flow path to receive water, and wherein the separator comprises a flow path to discharge remaining water.

* * * * *